United States Patent [19]

Shumaker

[11] 4,364,705

[45] Dec. 21, 1982

[54] LOADER MECHANISM

[75] Inventor: John F. Shumaker, Mt. Pleasant, Iowa

[73] Assignee: J. I. Case Company, Racine, Wis.

[21] Appl. No.: 166,061

[22] Filed: Jul. 7, 1980

[51] Int. Cl.[3] ..... E02F 3/00

[52] U.S. Cl. ..... 414/713; 414/706

[58] Field of Search ..... 414/706, 706, 712, 713

[56] References Cited

U.S. PATENT DOCUMENTS

| | | | |
|---|---|---|---|
| 2,817,448 | 12/1957 | Pilch | 414/713 |
| 3,122,246 | 2/1964 | Freedy | 414/713 |
| 3,412,885 | 11/1968 | Pensa | 414/713 |
| 3,720,338 | 3/1973 | Stout | 414/713 |
| 3,786,953 | 1/1974 | Crum | 414/713 |

*Primary Examiner*—Douglas C. Butler
*Assistant Examiner*—Terrance L. Siemens
*Attorney, Agent, or Firm*—Dressler, Goldsmith, Shore, Sutker & Milnamow, Ltd.

[57] ABSTRACT

A linkage system for automatically maintaining the orientation of a bucket of a loader while the lift arms are moved between raised and lowered positions is disclosed. A pair of articulated links are added to the linkage producing the self-leveling function to increase or decrease the amount of tilt applied to the rolled back bucket relative to the tilt applied to the bucket by the cross link alone. The articulated links are also used to maximize the force applied to the bucket to rotate it from the dig position to the rolled back position. The combination of a self-leveling feature together with a loader applying the maximum available force to roll back the bucket results in a loader arrangement which optimizes the efficiency of the loader and the productivity of the operator.

8 Claims, 7 Drawing Figures

LOADER MECHANISM

TECHNICAL FIELD

This invention relates to material-handling equipment and, particularly, to a loader linkage that is secured to a prime mover, such as a tractor, and that includes a pivotally mounted implement disposed across its front end.

BACKGROUND OF THE INVENTION

Tractor loaders generally include one or a pair of lift arms pivotable at one end on the tractor or tractor framework and pivotally supporting the bucket at the other end. The lift arm or arms can be raised by means of a hydraulic ram or rams acting between the tractor and the lift arms. The bucket can be pivoted fowardly or rearwardly by one or more bucket rams acting through a parallelogram linkage.

The normal operation of a loader involves positioning the bucket to a "dig" or working position and then forcing the bucket into a pile of material by the forward motion of the tractor. The bucket is then pivoted or "rolled back" on the lift arm while the lift arm is raised to force or break out the mass of material within the bucket from the remainder of the pile. Subsequently, the lift arms are elevated a sufficient distance to raise the bucket above the ground and then the vehicle is driven to some other location. Upon reaching the subsequent location, the bucket is pivoted to a "dumping position" where the contents are discharged after which the operation is repeated.

Unless the loader linkage employs a so-called "self-leveling feature," as the bucket is raised, the bucket itself tends to rotate about the lift arms in the same direction as the lift arms are rotating about the frame of the tractor. In other words, with an ordinary tractor loader linkage, the tendency for the bucket is to spill its contents as it is raised above the tractor. To prevent the spillage of the material contained in the bucket, the loader operator has to rotate the bucket relative to the lift arms in the opposite direction that the lift arms are tending to rotate the bucket.

Several linkages have been devised that automatically level the bucket as the lift arms are raise. One common loader linkage having a self leveling function utilizing a "cross-over lever"—a link pivoted intermediate its ends—on each lift arm. The shovel loader described by E. A. Drott in U.S. Pat. No. 2,482,612 is one example. Typically, one end of the cross-over lever is pivotally linked to the bucket and the other end is pivoted to a hydraulic actuator or bucket ram which is itself pivotally connected to the frame of the loader.

A careful study of the loader linkage will show that the "self-levelling" of the bucket is only approximate. In other words, there are certain positions in the raising and lowering cycle of the lift arms during which the counter rotation applied to the bucket by the cross-over lever is more than what is necessary to keep the bucket essentially level; there are also positions where the amount of counter rotation is less than what is necessary to maintain the bucket essentially level.

Another disadvantage of a self-leveling loader linkage incorporating only a cross-over lever is that various parts of the linkage tend to foul each other unless the lift arm and the linkage tilting the bucket are transversely offset from each other. Although offsetting the linkage on either side of the lift arm tends to solve the fouling problem, it creates still another problem. Such an off-set imparts "load couples" to the linkage which are difficult to counteract. These load couples tend to cause undue stress and wear on the linkage and especially the pivot pins. Moreover, offsetting the bucket ram often interferes with the driver's view of the bucket and further complicates the design of the loader linkage.

Turning to the hydraulic actuator or bucket ram that actually tilts the bucket, the bucket ram performs two functions: (1) It rolls back the bucket to fill the bucket when the bucket and the lift arms are in the lowered position; and (2) It tips or tilts the raised bucket forward to dump the contents of the bucket. Comparatively speaking, the greatest load imposed upon the bucket ram is when rolling back a heavily loaded bucket. Very little force is required to tip the raised bucket since, for the most part, gravity is assisting the bucket ram. Consequently, the loader linkage should be arranged in such a manner that the maximum available force from the bucket ram can be used to roll back the bucket. In addition, to avoid load couples and unbalanced moments tending to distort or otherwise bind the loader linkage, the longitudinal axis or the line of force produced by the bucket ram should be parallel to and in the same vertical plane as the link tilting the bucket about the lift arm.

Thus, it should be apparent that there are two problems associated with the design of a loader linkage: (1) Preferably, the linkage should be self-leveling over the entire range of the raising and lowering cycle of the lift arms; and (2) The loader linkage should provide the maximum force available to roll back the bucket during loading. A loader design providing an optimum solution to these two problems would increase the efficiency of the loader and the productivity of the machine's operator.

SUMMARY OF THE INVENTION

In accordance with the present invention, there is provided a loader mechanism which incorporates a linkage that not only holds the bucket in an essentially fixed orientation while the lift arms are raised and lowered but also maximizes the force available to roll back the bucket during filling. In this way, spillage of the load over the back wall or spill wall of the bucket during the lifting movement is reduced and the bucket is filled quickly and without hesitation. Specifically, a cross-over lever is used to level the bucket while the lift arms are moved between raised and lowered positions. To compensate for the non-linearity of the rotation of the cross-over lever a pair of articulated links are interposed between the cross-over lever and the linkage joining the cross-over lever to the bucket. Adjusting the length of the two articulated links in relation to the cross-over lever improves the linearity of the leveling effect on the bucket. In addition, the hydraulic actuator operating the cross-over lever to pivot the bucket about the lift arms is positioned in such a manner that the longitudinal axis of the actuator is essentially parallel to the longitudinal axis of the bucket tilting linkage. By arranging these linkages aligned to one another, the force available to roll back the bucket during filling is maximized. Moreover, by maintaining an in-line relationship the force components that is otherwise available to produce a lateral force or twisting moment tending to bend or otherwise distort the linkage is minimized. Numerous other advantages and features of the present invention will become readily apparent from the following detailed description of the invention and the embodiments illustrated therein, from the claims and from the accompanying drawings.

DETAILED DESCRIPTION

Figure 1:
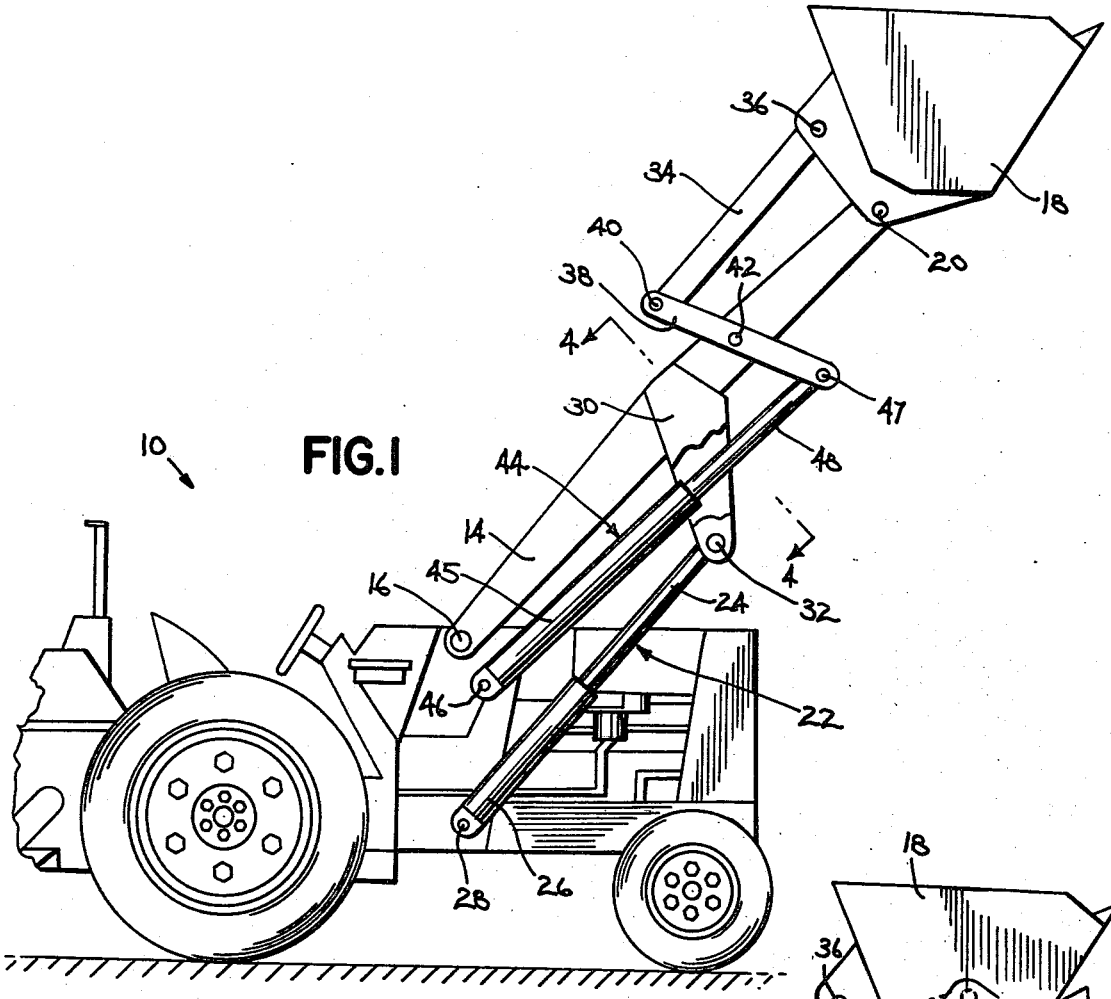
FIG. 1 is an elevational view of the right side of a typical tractor loader having a cross-over lever to self level the bucket.

While this invention is susceptible of embodiment in many different forms, there is shown in the drawings, and will herein be described in detail, specific embodiments with the understanding that the present disclosure is to be considered as an exemplification of the principles of the invention and is not intended to limit the invention to the specific embodiments illustrated.

Referring to the drawings, FIG. 1 is an elevational view of the right side of a tractor 10 on which has been mounted at the front end thereof a loader mechanism 12. The tractor 10 provides a support frame and a source of hydraulic power to operate the loader mechanism 12. The components of the loader mechanism 12 are, for the most part, duplicated on either side of the tractor 10; for this reason, only those components on the right side of the tractor 10 will be described in detail with the understanding that the description will likewise refer to an identical set of components located on the left side of the tractor 10.

Figure 4:
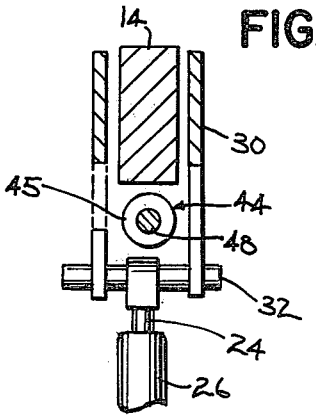
FIG. 4 is a cross-sectional view of a portion of the loader linkage shown in FIG. 1 as viewed along line 4—4 of FIG. 1.

As illustrated in FIG. 1, the loader mechanism 12 includes a lift arm 14 pivotally connected at one end to the tractor frame by pivot pin 16 and pivotally connected at the opposite end of the bucket 18 by pivot pin 20. The lift arm 14 is pivoted about pin 16 on the tractor 10 by the operation of a hydraulic actuator 22 (hereinafter alternately referred to as the lift arm actuator) through the extension or retraction of a piston rod 24 extending outwardly from a hydraulic cylinder 26. As shown in the drawings, the cylinder portion of the hydraulic actuator 22 is pivoted at one end to the tractor frame by a pivot pin 28. The other end of the piston rod 24 is disposed between and connected to a pair of downwardly extending reinforcing plates 30 by a pivot pin 32. The plates 30 are secured to an intermediate portion of the lift arm 14 (see FIG. 4). Thus, it can be seen that when fluid is applied to the lefthand end of the cylinder 26, the lift arm 14 will be rotated in a counterclockwise direction about pivot pin 28 to raise the bucket 18. Conversely, when fluid is supplied to the righthand end of the cylinder 26, the lift arms will be rotated in the clockwise direction to lower the bucket 18.

The positioning of the bucket 18 relative to the lift arm 14 is accomplished by a hydraulically operated bucket positioning mechanism. The hydraulically operated bucket positioning mechanism joins the bucket 18 with the lift arm 14. Depending upon the size of the bucket 18 and the load, the bucket positioning mechanism can consist of two otherwise identical mechanisms on either side of the tractor or a single mechanism on one side of the tractor. The bucket positioning mechanism consists of a first link 34 joined to the bucket 18 at one end by a pivot pin 36 and at the opposite end to a cross-over lever or cross link 38 by a pivot pin 40. The cross link 38 is pivotally connected to the lift arm 14 by a pivot pin 42 at a point intermediate its ends. Typically, the cross link 38 is a pair of links joined to either side of the lift arm 14. It thus can be seen that pivotal movement of the cross link 38 about pivot pin 42 joined to the lift arm 14 will pivot the bucket 18 in the same direction about the end of the lift arm 14.

To move the first link 34, the cross link 38, and the bucket 18, a hydraulic actuater 44 (hereinafter, alternatively referred to as the bucket actuator) is used which pivotally connects the cross link 38 with the tractor 10. The piston rod portion 48 of the bucket actuator 44 extends forwardly along the lift arm 14 and is pivotally connected at its end to the cross link 38 by a pivot pin 47. The cylinder portion 45 of the bucket actuator 44 is pivotally connected to the tractor 10 by a pivot pin 46.

Thus, the introduction of pressurized fluid to one end of the bucket actuator 44 and the corresponding withdrawal of fluid from the other end results in axial movement of the bucket actuator which causes the pivotal movement of the cross link 38 and the corresponding pivotal movement of the first link 34 and bucket 18. It is, of course, understood that if two bucket actuators 44 are used, they are operated simultaneously to bring about the desired result. The particular details of the hydraulic system used to operate such a loader mechanism just described should be well-known to those skilled in the art. The loader described by E. B. Long in U.S. Pat. No. 3,220,580 (and assigned to the assignee of the present invention) is incorporated by reference insofar as it describes the details of a typical hydraulic system used to operate the loader mechanism 12.

The loader mechanism 12 incorporates a "self-leveling feature." In other words, the loader mechanism 12 shown in FIG. 1 automatically rotates the bucket 18 clockwise when the lift arm 14 is rotated counterclockwise, thus maintaining the bucket 18 in an essentially level condition. Specifically, as the lift arm actuator 22 is operated to rotate the lift arm 14 in the counterclockwise direction, the bucket actuator 44 is also rotated counterclockwise by virtue of the cross link 38 pivotally connecting the piston rod 48 with the lift arm 14. Inasmuch as the cross link 38 is rigid, the raising of the lift arm 14 forces the bucket actuator 44 to maintain its position generally parallel to the lift arm 14 while at the same time rotating the cross link 38 clockwise. Thus, the counterclockwise rotation of the bucket 18 produced by the raising of the lift arm 14 is counteracted by the clockwise rotation of the bucket 18 induced by the rotation of the cross link 38. Therefore, the bucket 18 is kept essentially in the same relative orientation while it is moved between lowered and raised positions.

The total angle through which the bucket 18 is rotated by the cross link 38 is a function of the geometry of the loader mechanism 12. If the amount of counter rotation applied to the bucket 18 by the cross link 38 is equal to the amount of bucket rotation due to the rotation of the lift arm 14, then the bucket will remainsubstantially in the same relative orientation. On some machines the bucket 18 is rotated too far clockwise by the cross link 38 and therefore the bucket is tilted slightly forward (assuming that the bucket was raised while in the rolled back condition). On other machines, the bucket 18 is not rotated enough, and consequently it is tilted rearwardly. What is needed is a convenient way to increase or decrease the amount of rotation applied to the bucket by the cross link. In accordance with one aspect of the present invention, a pair of articulated links are added to the cross link 38 of the loader mechanism 12 shown in FIG. 1 to increase or decrease the amount of rotation applied to the bucket to improve the self leveling action of the loader mechanism.

Figure 2:
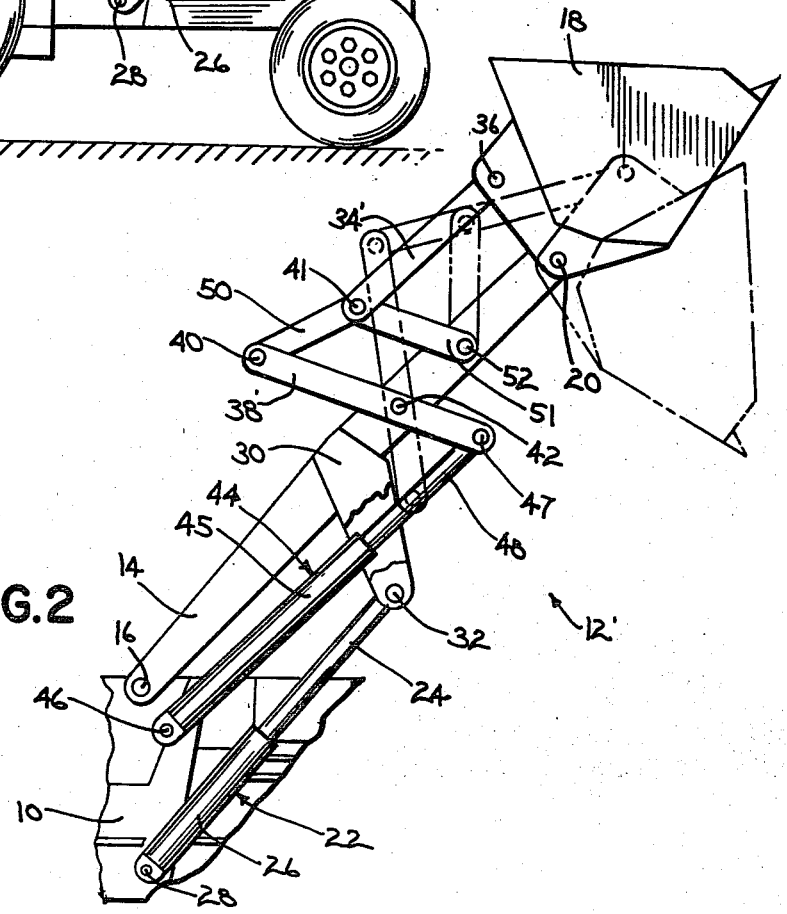
FIG. 2 is a partial, elevational view of the tractor loader shown in FIG. 1 incorporating one embodiment of the present invention and illustrating the bucket in a rolled back and in a dumped position.

FIG. 2 illustrates the first embodiment of the invention. The loader mechanism 12' is otherwise identical with loader mechanism 12 showing FIG. 1 with the exception that two articulated links 50, 51 have been added: a second link 50 and a third link 51. The second link 50 pivotally connects one end of the cross link 38' with one end of the first link 34'. Specifically, one end of the second link 50 is pivotally connected to the cross link 38' by a pivot pin 40 while the other end is pivotally connected to the first link by a pivot pin 41. The third link 51 is pivotally connected at one end to the lift arm 14 by a pivot pin 52. The other end of the third link 51 is pivotally connected at the joint between the second link 50 and the first link 34' by the common pivot pin 41. The length of the third link 51 relative to the pivoting length of the cross link 38'—measured between the pivot pin 42 joining the cross link to the lift arm 14 and the pivot pin 40 joining the cross link to the second link 50—has an effect on the amount by which of the bucket 18 is rotated when the lift arm 14 are raised.

Figure 5A:
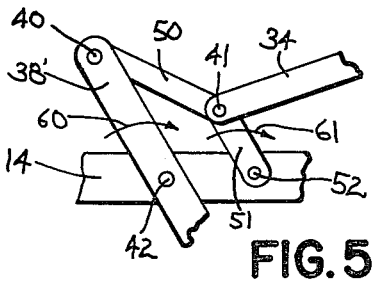
FIG. 5A is a fragmentary elevational view of a portion of the loader linkage illustrated in FIG. 2.
Figure 5B:
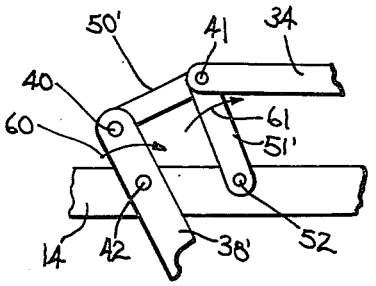
FIG. 5B is a variation of the linkage illustrated in FIG. 5A wherein the length of the third link is greater than the corresponding pivoting length of the cross-over lever.

The angle through which the cross link 38' rotates when the lift arm 14 is raised or lowered is dependent upon the length of the bucket actuator 44 (for any given degree of bucket tilt) and the angular relationship between the longitudinal axis of the bucket actuator and the longitudinal axis of the first link 34'. In other words, for any given extension of the bucket actuator 44, the rotation produced by the cross link 38' due to the motion of the lift arm 14 is dependent upon: (1) the location of the pivot pin 46 (see FIG. 2) joining the bucket actuator 44 with the tractor 10 relative to the location of pivot pin 16 joining the lift arm to the tractor; and (2) the effective pivoting length of the cross link (measured between the pivotal connection 42 to the lift arm and the pivotal connection joining the cross link with the piston rod 48 of the bucket actuator). By inspection of FIG. 2, it should be apparent that if the length of the third link 51 is equal to the effective pivoting length of the cross link 38'—measured between the pivot pin 42 joining the cross link to lift arm 14 and the pivot pin 40 joining the cross link with the second link 50, then the third link and the cross link will rotate the same amount. However, as the third link 51 becomes shorter (see FIG. 5A) or longer (see FIG. 5B), the angle (arrow 61) through which the third link is rotated will either be more or less than the angle (arrow 60) through which the cross link 38' is rotated.

More specifically, if the third link 51 is shorter (see FIG. 5A) than the corresponding portion of the cross link 38', the angle (arrow 61) through which the third link is rotated is greater than the angle (arrow 60) through which the cross link 38' is rotated. Similarly, if the third link 51' is greater in length (see FIG. 5B) than the corresponding length of the cross link 38', the angle (arrow 61) through which the third link is rotated is less than the angle (arrow 60) through which the cross link is rotated. Consequently, the amount of tilt induced on the bucket 18 by the cross link 38' can be controlled by adjusting the length of the cross link and the length of the third link 51. In effect, the second link 50 and the third link 51 function as "amplifying links" or "multiplying links" in the sense that they increase or decrease the tilt of the bucket 18 over what would be produced by the cross link 38' alone.

Figure 3:
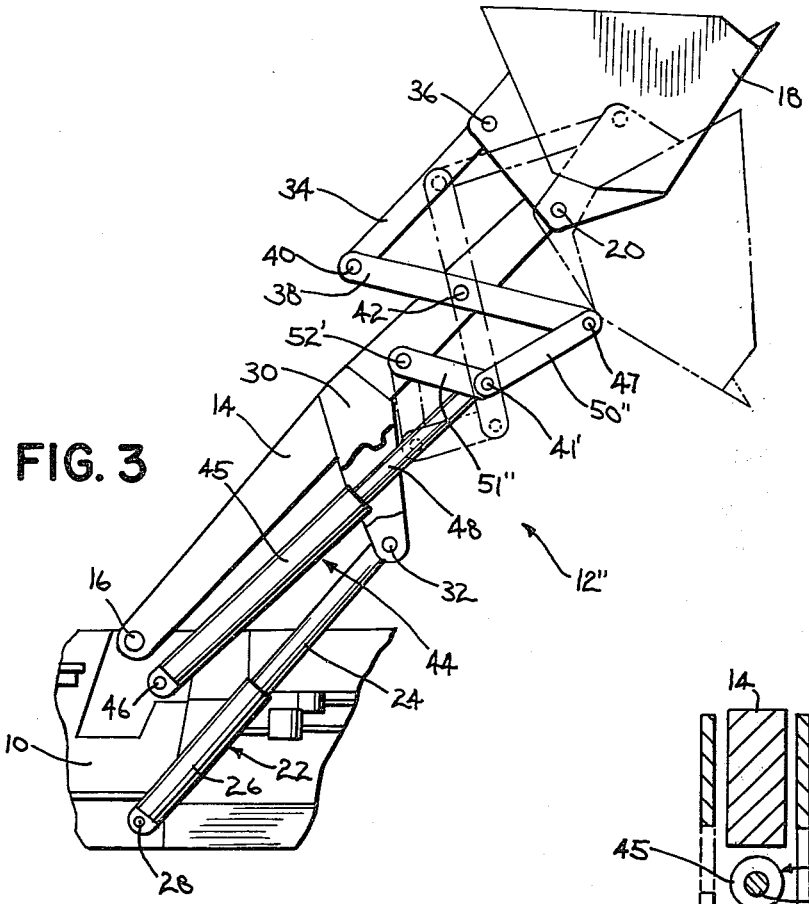
FIG. 3 is a partial, elevational view of the tractor loader shown in FIG. 1 incorporating a second embodiment of the present invention and illustrating the bucket in a rolled back and in a dumped position.

FIG. 3 illustrates a second embodiment of the loader mechanism. That loader mechanism 12'' is otherwise identical to the loader mechanism 12' shown in FIG. 2 with the exception that the second link 50'' and the third link 51'' have been positioned on the opposite side or lower side of the lift arm 14. The loader mechanism 12'' operates according to the principles previously described. Here, however, the second link 50'' and the third link 51'' directly multiply the amount of rotation imparted to the cross link 38 and the bucket 18 by rotation of the lift arm 14. Thus when the lift arm 14 is raised, the bucket actuator 44 acts like a fixed link and forces the third link 51'' to be rotated relative to the lift arm. This in turn displaces the second link 50 and rotates the cross link 38. The size of the bucket 18, the size of the lift arm 14, and the space available between the cross link 38 and the lift arm actuator 22 are factors to be considered in determining which of the two embodiments is preferable.

Figure 5C:
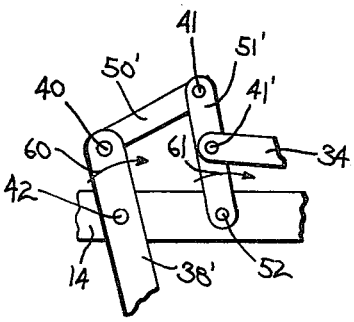
FIG. 5C is a modification of the linkage illustrated in FIG. 5B when the first link is pivoted to the third link at a point intermediate the ends of the third link.

Thus, for a given cross link, the lengths of the second link 50 and third link 51 can be adjusted to control the total angle through which the bucket 18 is rotated when the lift arm 14 is raised. It should be noted that the first link 34 can be pivotally connected to the third link 51 at any point and not just at that point on the third link where the third link is pivotally connected to the second link 50 (See FIG. 5C). The same principles apply. Another factor must be considered in selecting the relative lengths of the cross link 38, the second link 50, and the third link 51. That factor is the position of the bucket actuator 44 relative to the first link 34.

When the lift arm 14 is in the lowered position and the bucket 18 is aligned to a dig position, the bucket is ready to be loaded. Once the bucket 18 has been driven in to the pile of material to be loaded, the bucket is pivoted or rolled back relative to the lift arm 14 and the lift arm is raised to force or break out the mass of material within the bucket from the remainder of the pile. Consequently, the greatest force is applied to the bucket 18 by the first link 34 when the bucket is being "rolled back." Therefore, the bucket actuator 44 should be orientated relative to the bucket 18 and the lift arm 14 so that the full ares of the piston within the hydraulic actuator is exposed to hydraulic pressure in rolling back the bucket. The drawings illustrated this preferred arrangement. Under these circumstances, the bucket actuator 44 has its piston rod 48 pointing outwardly in the direction of the bucket 18 or away from the tractor 10.

The forces applied to the two ends of the cross link 38 form what is known as a "couple." A couple is produced when the forces applied to an object are equal in magnitude but opposite in direction (i.e., one where the forces have lines of action which are parallel to each other). Since the forces are equal and opposite, a couple does not produce linear motion. The only effect of a couple is to produce rotation of the body upon which it acts. The cross link 38 produces this effect. If the geometry of the links forming the loader mechanism 12', 12'' is such that the forces applied to the cross link 38, 38' are parallel to each other and to either side of the pivot axis 42 of the cross link, then the only effect of those forces is to produce a couple. If a couple is produced, then there are no forces which act to distort or otherwise bend or deflect the various links comprising the loader mechanism 12', 12''. In other words, all of the force produced by the bucket actuator 44 is used to rotate the bucket 18. Consequently, by adjusting the lengths of the various links forming the loader mechanism 12', 12'', the force applied to rotate the bucket 18 from the dig position to the rolled back position can be maximized. If the cross link 38' is sufficiently long that the link 34 joining the bucket 18 to the cross link is not parallel to the axis of the bucket actuator 44, then the third link 51 and the second link 50 can be used to make this adjustment (See FIGS. 5A, 5B, and 5C).

Therefore, there are at least two preferred embodiments. In the first preferred embodiment, the linkage are arranged in such a manner that (with the lift arm 14 in the lowered position and with the bucket 18 aligned to the dig position) the line of force produced by the bucket actuator 44 is generally parallel to the longitudinal axis of the first link 34. Under this arrangement, the total angle through which the bucket 18 is rotated when the lift arm 14 is raised and lowered may not be enough to keep the bucket perfectly level. In the second preferred embodiment the linkages are arranged in such a manner that (with the bucket 18 in the rolled back position) the bucket remains level as the lift arm 14 is raised and lowered. Under this arrangement, the magnitude and direction of the force or power applied to the bucket 18 is of a secondary importance. The designer, by interpolating between these two extremes can select that arrangement of the linkages and actuators forming the loader mechanism 12', 12'' which results in the best combination of self-leveling and force to roll back the bucket.

Thus, it is apparent that there has been provided in accordance with the invention a wide variety of linkage arrangements that produce selfleveling of the bucket in a tractor loader and at the same time produce the maximum force available to roll back the bucket. There are other advantages. For example, by keeping all of the linkage components in a straight line, stress on the links is reduced. In addition, the bucket actuator is kept at the lower end of the lift arm where it is less likely to be damaged. This also simpifies the routing of hydraulic hoses and fittings. Finally, the bucket dumps faster since the piston rod side of the bucket actuator is pressurized to rotate the bucket to the dump position.

While the invention is described in conjunction with two specific embodiments, it is evident that many alternatives, modifications, and variations will be apparent to those skilled in the art, in light of the foregoing detailed description. Accordingly, as intended to cover all such alternatives, modifications, and variations as set forth within the spirit and broad scope of the appended claims.

What is claimed is as follows:

1. An improved loader, comprising:

(a) a frame;

(b) a material-handling implement, disposed at the front end of said frame;

(c) a lift arm pivoted at one end to said frame and at the opposite end to said implement;

(d) first fluid ram means, pivotally joining said frame and said lift arm, for moving said implement relative to said frame between a raised position and a lowered position;

(e) a cross link pivoted at a point intermediate its ends to said lift arm;

(f) link means, pivotally connected at one end to said implement at a distance spaced from the pivotal connection between said lift arm and said implement and pivotally connected at its other end to one end of said cross link, for linking said implement to said cross link; said link means including a first rigid link pivotally connected at one end to said implement, a second rigid link pivotally connected at one end to said one end of said cross link and at its other end to the other end of said first rigid link, and a third rigid link pivotally connected at one end to said lift arm at a point on said lift arm between the pivotal connection of said cross link to said lift arm and the pivotal connection of said implement to said lift arm and at its other end to said other end of said second rigid link, with said other end of said first rigid link being pivotally connected to said third rigid link; and (g) second fluid ram means, pivotally connected at one end to said frame and at the opposite end to the other end of said cross link, for rotating said implement relative to said lift arm between a rolled back position and a dump position, the dig position of said implement lying between said rolled back and said dump positions, the piston rod portion of said second fluid ram means being pivotally connected to said cross link and being disposed parallel to said first rigid link when said implement is in the dig position, whereby the maximum force available from said second fluid ram means is used to pivot said implement from the dig position to said rolled back position, and the extension and retraction of said first fluid ram means raising said lift arm relative to said frame and forcing said cross link to rotate said implement to compensate for the rotation of said implement induced by the rotation of said lift arm alone, whereby said implement when in the rolled back position remains essentially in the same orientation relative to said frame while said implement is moved by said lift arm between lowered and raised positions.

2. The loader defined in claim 1, wherein said second rigid link and said third rigid link and said first rigid link are pivoted together at a common point, and wherein the pivoting length of said third rigid link is greater than the pivoting length of said cross link as measured between the pivotal connection of said cross link to said lift arm and the pivotal connection of said cross link to said second rigid link, whereby the angle through which the implement rotates by rotating said lift arm is less than the angle through which the cross link rotates.

3. The loader defined in claim 1, wherein said second rigid link and said third rigid link and said first rigid link are pivoted together at a common point and wherein the pivoting length of said third rigid link is less than the pivoting length of said cross link as measured between the pivotal connection of said cross link to said lift arm and the pivotal connection of said cross link to said second rigid link, whereby the angle through which the implement rotates by rotating said lift arm is greater than the angle through which the cross link rotates.

4. An improved loader, comprising:

(a) a frame;

(b) a material-handling implement, disposed at the front end of said frame;

(c) a lift arm, pivoted at one end to said frame and at the opposite end to said implement;

(d) first fluid ram means, pivotally joining said frame and said lift arm, for moving said implement relative to said frame between a raised position and a lowered position;

(e) a cross link pivoted at a point intermediate its ends to said lift arm;

(f) link means, pivotally connected at one end to said implement at a distance spaced from the pivotal connection between said lift arm and said implement and pivotally connected at its other end to one end of said cross link, for linking said implement to said cross link; said link means including a first rigid link pivotally connected at one end to said implement and at its other end to said one end of said cross link, a second rigid link pivotally connected at one end to the other end of said cross link, a third rigid link pivotally connected at one end to said lift arm and at its other end to the other end of said second rigid link;

(g) second fluid ram means, pivotally connected at one end to said frame and at the opposite end to the other end of said third rigid link, for rotating said implement relative to said lift arm between a rolled back position and a dump position, the dig position of said implement lying between said rolled back and said dump positions, the piston rod portion of said second fluid ram means being pivotally connected to said cross link and being disposed parallel to said first rigid link when said implement is in the dig position, whereby the maximum force available from said second fluid ram means is used to pivot said implement from the dig position to said rolled back position, and the extension and retraction of said first fluid ram means raising said lift arm relative to said frame and forcing said cross link to rotate said implement to compensate for the rotation of said implement induced by the rotation of said lift arm alone, whereby said implement when in the rolled back position remains essentially in the same orientation relative to said frame while said implement is moved by said lift arm between lowered and raised positions.

5. The loader defined in claim 1 or 4, wherein the longitudinal axis of said second fluid ram means is at a generally lower elevation than the longitudinal axis of the implement end of said lift arm.

6. The loader defined in claim 1 or 4, wherein the lengths of said cross link and said third link are adjusted such that, when said implement is in said rolled back position, the angular rotation of said implement induced by said one link counteracts the angular rotation of said implement induced by said lift arm whereby said implement remains in substantially the rolled back position when said lift arm is raised.

7. The loader defined in claim 1 or 4, wherein the longitudinal axis of said second fluid ram means, said lift arm, and said first rigid link all lie in generally the same plane.

8. The loader defined in claim 1 or 4, wherein said lift arm is straight, and the longitudinal axes of said second fluid ram means, said lift arm, and said first rigid link are all parallel to one another when said implement is in said dig position.

* * * * *